US006048197A

United States Patent [19]

Beiler

[11] Patent Number: 6,048,197

[45] Date of Patent: Apr. 11, 2000

[54] AIR FLOW CONTROL HEAD FOR MULTI OIL FURNACES

[75] Inventor: Emanuel S. Beiler, Gordonville, Pa.

[73] Assignee: Clean Burn, Inc., Leola, Pa.

[21] Appl. No.: 09/104,600

[22] Filed: Jun. 24, 1998

[51] Int. Cl.[7] ..... F23Q 3/00

[52] U.S. Cl. ..... 431/265; 431/183; 239/406

[58] Field of Search ..... 431/265, 183; 239/406

[56] References Cited

U.S. PATENT DOCUMENTS

| | | | |
|---|---|---|---|
| 1,719,090 | 7/1929 | Stillman | 239/406 |
| 2,065,042 | 12/1936 | Berryman | 431/265 |
| 2,502,664 | 4/1950 | Hest | 431/265 |
| 3,285,316 | 11/1966 | Gustafson et al. | 431/265 |
| 3,309,027 | 3/1967 | Chadwick et al. | 239/406 |
| 3,360,201 | 12/1967 | Popyk | 239/406 |
| 3,490,858 | 1/1970 | Fletcher | 431/265 |

*Primary Examiner*—Carroll Dority

[57] ABSTRACT

A retention head for the end of the burner nozzle housing on a waste oil furnace controlS the flow of combustion air relative to the flame produced by the burner nozzle. The retention head is formed as a cup-shaped member that mounts in a detachable manner on the outside of the burner nozzle housing. The retention head has an operative face having a central opening through which a portion of the combustion air can flow and support the flame passing through the opening. A solid ring defining the central opening forces air into circumferential vented slots around the perimeter of the retention head. The vented slots have angled flaps that direct the combustion air into a spiraled flow pattern circumferentially around the flame. The retention head has an inwardly curved periphery to help direct combustion air into an inward pattern surrounding the flame. Slotted openings allow an adjustable positioning of the retention head relative to the burner nozzle housing to permit the head to be properly positioned in order to keep the spiraled flow of combustion air parallel to the orientation of the flame.

12 Claims, 5 Drawing Sheets

Fig. 4
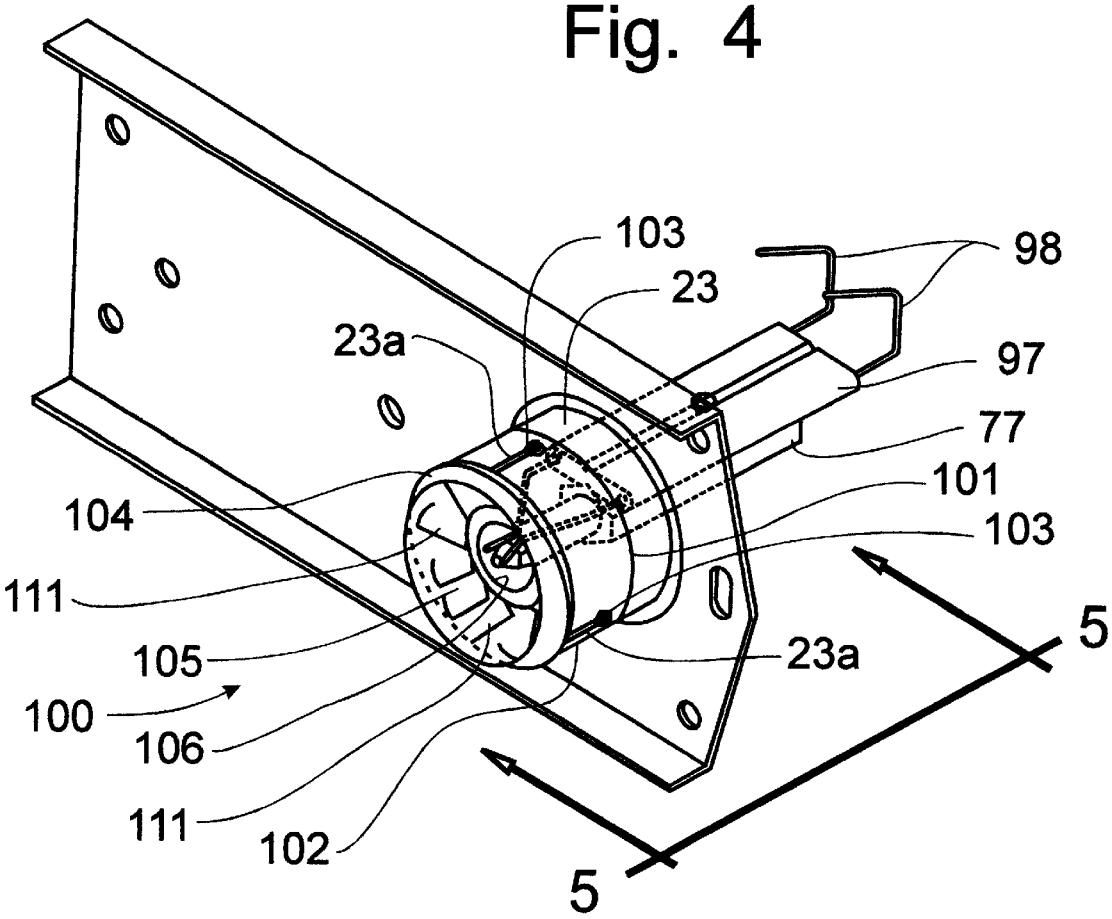
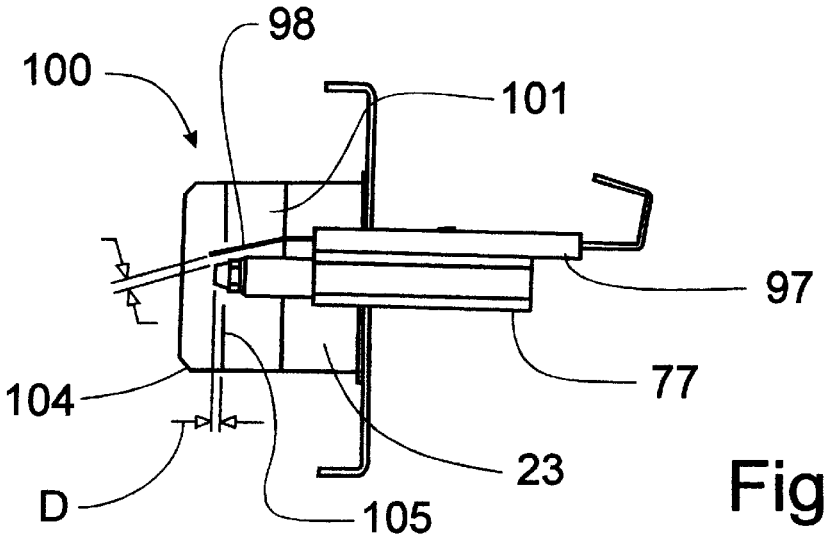
Fig. 5

AIR FLOW CONTROL HEAD FOR MULTI OIL FURNACES

BACKGROUND OF THE INVENTION

This invention relates generally to furnaces for the burning of used oil and, more particularly, to a retention head on the end of the burner nozzle assembly for use in controlling the flow of combustion air into the burner chamber of a multi oil furnaces to provide better control of the flame into the burner chamber.

Multi oil furnaces are similar to standard oil burning furnaces, but have been adapted to handle oil products that have been previously used in a traditional lubricating operation, such as used crankcase oil up to 50 SAE, used transmission fluid, and even #2, #4 and #5 fuel oils. Such oil products can have significantly varying viscosities and significantly varying burning characteristics, as well. Typically, used oil products are collected into a tank to be supplied to the furnace from a single source. As furnaces are normally operated when the ambient air temperatures are sufficiently cold to warrant the use of the furnace, the supply of used oil to the furnace is normally as cold as the ambient temperature, which requires a preheating of the used oil to more efficiently effect a burning of the used oil products.

The burner nozzle combines a flow of compressed air with the flow of preheated used oil to atomize the used oil and inject a stream of compressed air and atomized used oil droplets into the burner chamber of the multi oil furnace where it is ignited to create a heat source. Known multi oil furnace burner nozzles utilize an in-line burner nozzle configuration coupled directly into the preheater block and are positioned within the air flow stream of combustion air created by an external fan. Furthermore, the required imposition of an igniter mechanism further impedes the air flow of the combustion air into the burner chamber. All of this structure creates turbulences within the air flow stream of combustion air to detract from the efficient operation of the furnace.

Accordingly, it would be desirable to devise a more aerodynamic burner nozzle assembly that would minimize combustion air turbulences and, thereby, increase the burning efficiency of the multi oil furnace.

SUMMARY OF THE INVENTION

It is an object of this invention to provide a retention head for the end of the burner nozzle for a multi oil furnace that improves the burning efficiency of the furnace.

It is a feature of this invention that the burner assembly is more aerodynamically configured to minimize turbulences within the flow of combustion air over the burner assembly.

It is an advantage of this invention that the control of the combustion air flow increases the burning efficiency of the furnace.

It is another object of this invention to provide a retention head for controlling the flow of combustion air in a tight spiral around the flame from the burner assembly without disrupting the integrity of the flame.

It is another feature of this invention that the shape of the retention head directs combustion air inwardly toward the flame in a circumferential manner around the flame.

It is still another feature of this invention that the configuration of the retention head forces the flow of the combustion air into a spiral around the circumference of the flame from the burner assembly.

It is still another object of this invention that the retention head is fabricated to be detachable from the burner housing.

It is yet another feature of this invention that the mounting of the retention head utilizes slotted openings to permit the positional adjustment of the orientation of the retention head on the burner housing.

It is still another advantage of this invention that the adjustable mounting of the retention head allows the retention head to be oriented to provide the most efficient flow of combustion air around the circumference of the flame from the burner assembly.

It is a further feature of this invention that the retention head is fabricated with a solid ring around the burner nozzle to control the flow of combustion air relative to the flame from the burner nozzle.

It is yet another object of this invention to provide a retention head for a burner nozzle assembly on a multi oil furnace which is durable in construction, inexpensive of manufacture, carefree of maintenance, facile in assemblage, and simple and effective in use.

These and other objects, features, and advantages are accomplished according to the instant invention by providing a retention head for the end of the burner nozzle housing on a waste oil furnace to control the flow of combustion air relative to the flame produced by the burner nozzle. The retention head is formed as a cup-shaped member that mounts in a detachable manner on the outside of the burner nozzle housing. The retention head has an operative face having a central opening through which a portion of the combustion air can flow and support the flame passing through the opening. A solid ring defining the central opening forces air into circumferential vented slots around the perimeter of the retention head. The vented slots have angled flaps that direct the combustion air into a spiraled flow pattern circumferentially around the flame. The retention head has an inwardly curved periphery to help direct combustion air into an inward pattern surrounding the flame. Slotted openings allow an adjustable positioning of the retention head relative to the burner nozzle housing to permit the head to be properly positioned in order to keep the spiraled flow of combustion air parallel to the orientation of the flame.

BRIEF DESCRIPTION OF THE DRAWINGS

The advantages of this invention will become apparent upon consideration of the following detailed disclosure of the invention, especially when taken in conjunction with the accompanying drawings wherein:

FIG. 4 is an isometric detail view of the burner nozzle and associated burner housing having the retention head mounted thereon, the mounting screws being shown in an exploded format;

FIG. 5 is a schematic side elevational view of the burner nozzle and associated burner housing corresponding to lines 5—5 of FIG. 4 to depict the relative position of the retention head with respect to the tip of the burner nozzle;

DETAILED DESCRIPTION OF THE PREFERRED EMBODIMENT

Figure 1:
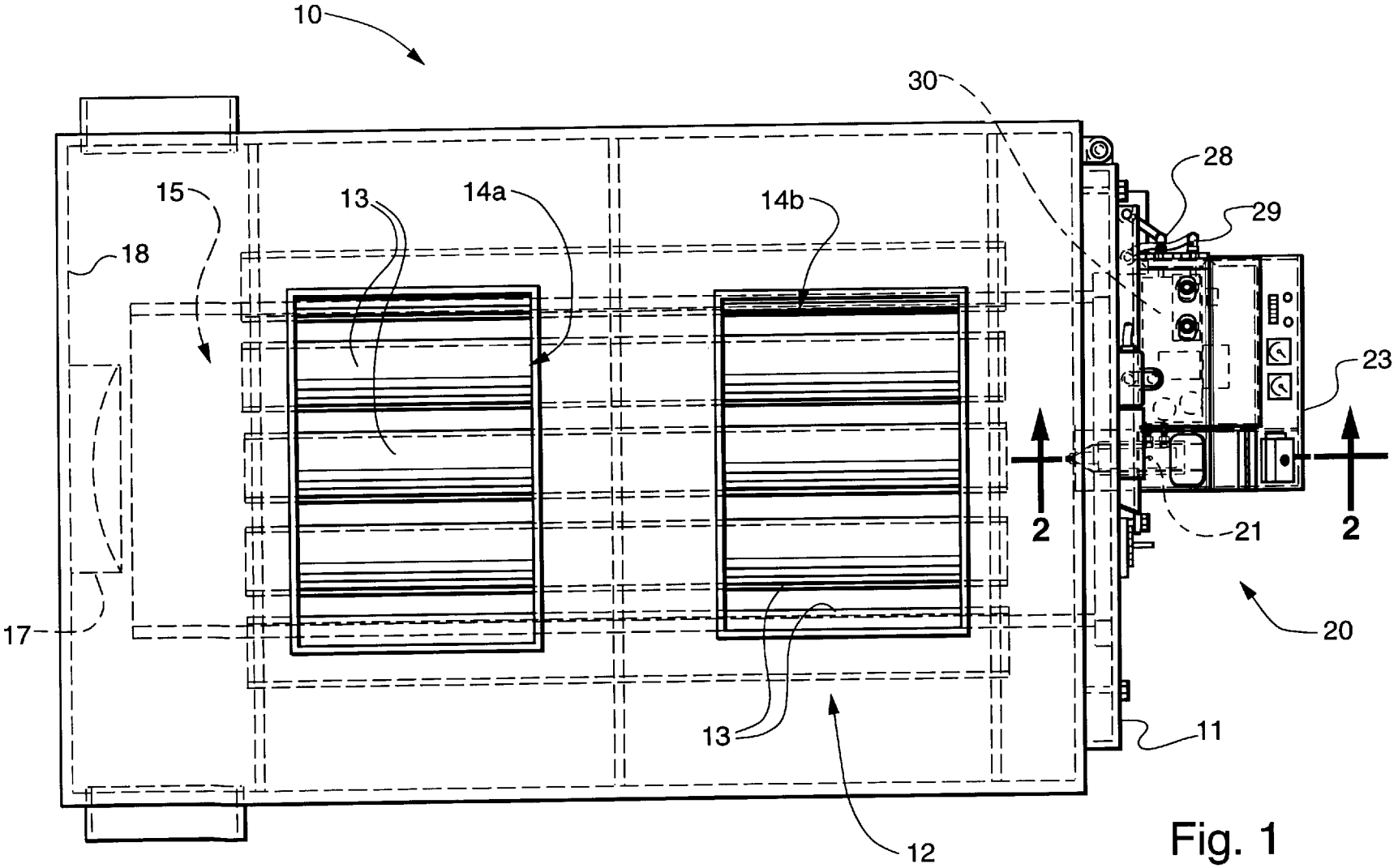
FIG. 1 is a top plan view of a multi oil furnace incorporating the principles of the instant invention.

Referring now to FIG. 1, a top plan view of a multi oil furnace incorporating the principles of the instant invention can best be seen. The construction and operation of a multi-oil furnace, such as shown in the drawings, is shown and described in greater detail in U.S. Pat. No. 5,531,212, granted on Jul. 2, 1996, to Benjamin K. Smoker, et al, the description portions of which are incorporated herein by reference. The furnace 10 includes a shell enveloping a heat exchanger 12 and a central burner chamber 15. A burner assembly 20 is mounted on the front door 11 to fire a flame into the burner chamber 15 toward a target 17 mounted on the back wall 18 of the burner chamber 15. The heat exchanger 12 allows the circulation of clean air to be heated around pipes 13 carrying heated combustion gases before being discharged from the furnace 12. The furnace 12 incorporates a clean air inlet opening 14*a* and a clean air exit opening 14*b* to provide for the passage of the clean air to be heated within the heat exchanger 12.

Figure 2:
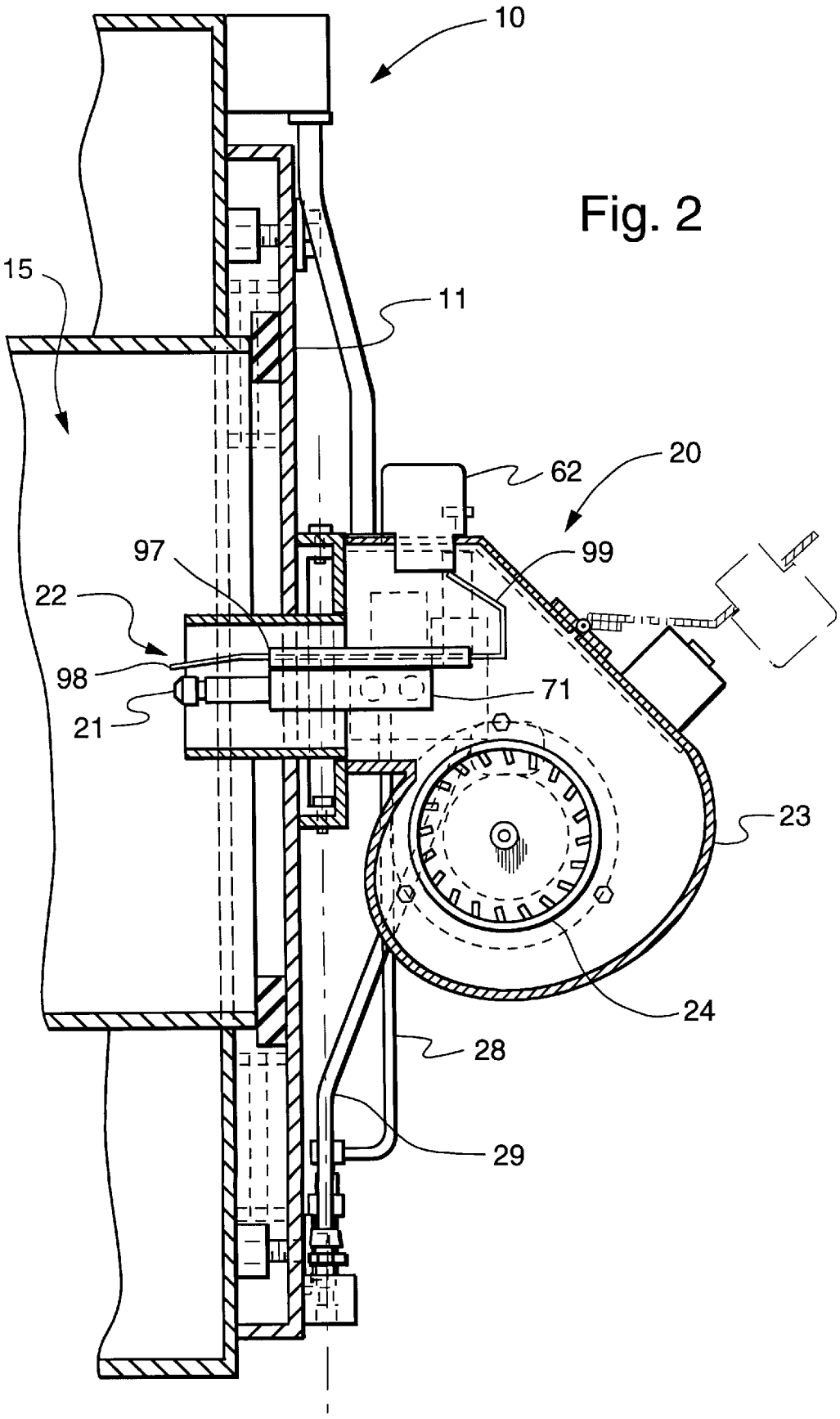
FIG. 2 is an enlarged cross-sectional view of the multi oil furnace taken along lines 2—2 of FIG. 1 to better show the burner assembly with the retention head mounted thereon.
Figure 3:
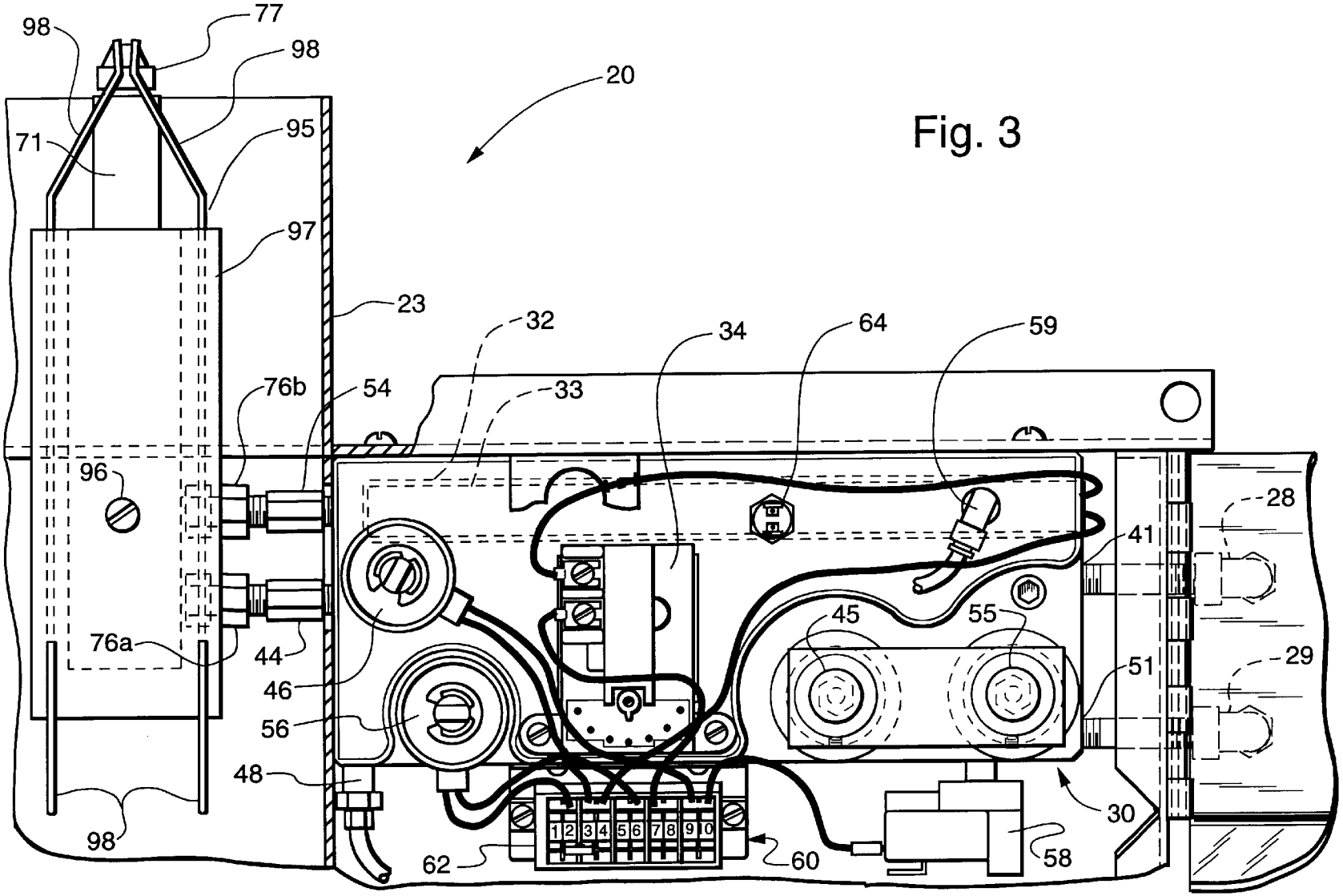
FIG. 3 is an enlarged partial cross-sectional view of the burner assembly to depict a top view of the preheater block.
Figure 6:
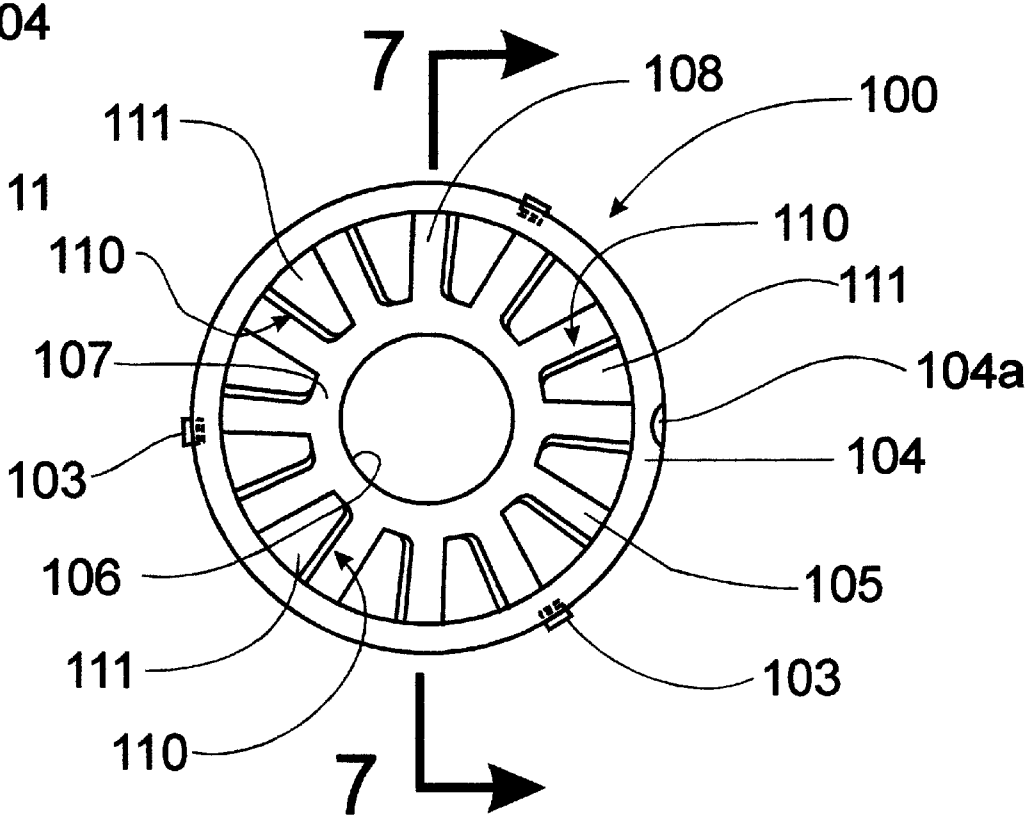
FIG. 6 is an enlarged front elevational view of the retention head looking concentrically into the central opening.
Figure 7:
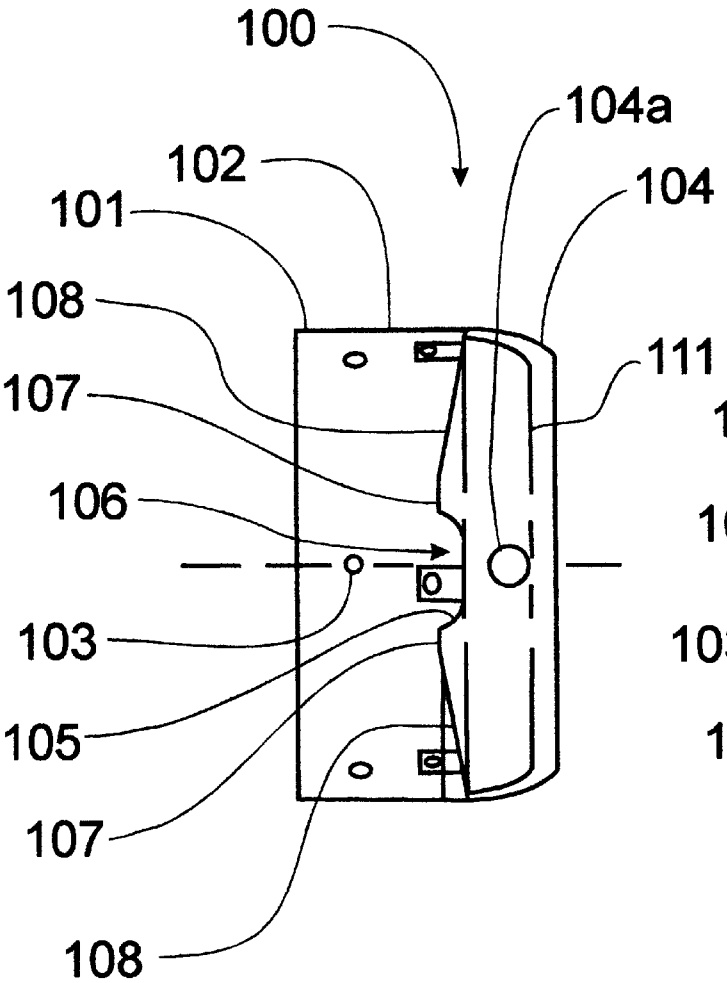
FIG. 7 is a cross-sectional view of the retention head taken along lines 7—7 of FIG. 6.

Referring now to FIGS. 2 and 3, the details of the burner assembly 20 and preheater block 30 can best be seen. The burner assembly 20 includes a burner nozzle 21 and an igniter 22 to create a flame from the used oil supplied thereto as defined in greater detail below. The burner assembly 20 also includes a housing 23 in which is mounted a fan 24 to supply large quantities of combustion air over the nozzle 21 and igniter 22 to support the creation of a flame in the burner chamber 15. The preheater block 30 is also mounted on the burner housing 23 adjacent the burner nozzle 21 and the igniter 22 to mount various controls for the flow of used oil and compressed air to the burner nozzle 21, as are described in greater detail in the aforementioned U.S. Pat. No. 5,531,212.

The preheater block 30 defines two separate flow paths for used oil and compressed air, respectively. The preheater block 30 is formed with a heater chamber 32 in which is housed a heating element 33, electrically coupled to a preheater thermostat 34 and a power supply 62. The heating element 33 is removably mounted within the heater chamber 32 and provides a source of heat when electrical current is passed through the heating element 33. The preheater block 30 is formed of metallic material, such as aluminum, and is, therefore, conductive of the heat generated by the heating element 33.

The flow of used oil is introduced into the preheater block 30 from the line 28 delivering unheated used oil from an external tank (not shown) to the inlet port 41. The flow path for the used oil through the preheater block 30 makes approximately seven passes through the block 30 before exiting the outlet port 44 to absorb conductive heat to enable the delivery of preheated used oil to the burner assembly 20. An oil flow regulator 45 is manually operable to control the rate of flow of used oil through the block 30 and, therefore, to the burner assembly 20. A solenoid shut-off mechanism 46 is coupled to the oil flow path immediately adjacent the oil outlet port 44 to minimize the amount of used oil that can drip through the burner nozzle 21. An oil pressure gauge 48 is tapped into the oil flow path down stream from the solenoid shut-off 46 to register the flow of used oil to the burner nozzle 21.

The flow of compressed air is introduced into the preheater block 30 through the air inlet port 51 from a connecting line 29 couple to a conventional source of compressed air (not shown). The flow path for the compressed air through the preheater block 30 makes approximately three passes through the block 30 to absorb sufficient conductive heat from the block 30 to raise the temperature to approximately the same level as the used oil before exiting the outlet port 54 for delivery of preheated compressed air to the burner assembly 20. An air flow regulator 55 is manually operable to control the flow of compressed air through the block 30 and, therefore, to the burner assembly 20.

A solenoid shut-off mechanism 56 is operable to halt the flow of compressed air through the system. An air pressure gauge 59 is tapped into the compressed air flow path down stream from the solenoid shut-off 56 to register the flow of compressed air to the burner nozzle 21. An air sensing switch 58 detects the presence of compressed air flowing to the burner nozzle 21 and is operable to prevent the oil solenoid shut-off 46 from opening whenever compressed air is not present in the system.

Referring now to FIG. 4, details of the burner nozzle assembly 70 can best be seen. The burner nozzle assembly 70 includes the burner nozzle 21 and the igniter assembly 95. The burner nozzle 21 includes a nozzle housing 71 having passageways (not shown) for the flow of compressed air and waste oil in a known manner to create a flame projected into the burner chamber 15. The burner nozzle 21 further includes a nozzle head 77 threaded into a passageway.

Referring now to FIGS. 2 and 3, it can be seen that the igniter assembly 95 is detachably mounted to the nozzle housing 71 by a fastener 96 passing through the insulator block 97. The electrodes 98 pass through the insulator block 97 and terminate adjacent the nozzle head 77 to provide a gap for initiating a spark in a conventional manner to ignite the stream of compressed air and atomized oil droplets. The electrodes 98 extend upwardly and rearwardly from the insulator block 97 to a terminal end contacting a source of electrical current 62.

Preheated used oil discharged from the preheater block 30 and flows through the oil inlet port 76*a* of the housing 71 and through a passageway into the nozzle head 77 to exit therefrom in a fine stream. Meanwhile, preheated compressed air is discharged from the preheater block 30 and is received through the air inlet port 76*b* to flow through another passageway into the nozzle head 77 where the flow of compressed air is directed in a slightly spiraled path. The compressed air and used oil streams are combined for the first time at the tip of the nozzle head 77 to effect an atomizing of the used oil stream, resulting in a combined stream of compressed air and atomized used oil droplets being ejected from the tip, whereupon it is ignited into a flame by the electrodes 98.

The flow of combustion air induced by the fan 24 flows around the insulator block 97 and the nozzle housing 71 and is contained within the burner housing 23 extending circumferentially around the nozzle housing 71. A formed sheet metal retention head 100 is detachably mounted on the end of the burner housing 23 extending into the burner chamber 15. As best seen in FIGS. 4–7, the retention head 100 is a cup-shaped member that is sized to fit over the external periphery of the burner housing 23 and extends over the tip of the nozzle head 77, projecting further into the burner chamber 15 than the tip of the nozzle head 77 such that the tip of the nozzle head 77 is recessed inside the retention head.

The retention head 100 has a generally cylindrical body member 101, including a base portion 102 formed in a generally circular cross-section to correspond to the shape of the burner housing 23 projecting into the burner chamber 15. The base portion 102 is provided with fastener openings 103 that are alignable with corresponding openings 23*a* in the burner housing 23. One of the openings 23*a,* 103 is formed as a slot to enable the retention head 100 to be adjustably positioned on the burner housing before being affixed thereto. The retention head 100 is positioned so that the flow of air exiting the retention head, as will be described in greater detail below, is oriented parallel to the flame being fired from the nozzle head 77. It is important that the retention head 100 not be tipped in orientation from side to side or from top to bottom.

The body member 101 terminates in an inwardly flared end portion 104, preferably formed integrally with the base portion 102, to be operable to direct combustion air inwardly toward the flame. A drain hole 104*a* is formed in the end portion 104 to permit any waste oil drips to drain out of the retention head 100. The drain hole 104*a* must be oriented at the bottom of the retention head 100 when properly installed on the burner housing 23 in order to be operable.

Recessed from the terminus of the flared end portion 104 is a vented face plate 105, preferably formed as a separate member affixed, such as by soldering, to the internal circumference of the body member 101, preferably approximately at the junction of the base portion 102 and the end portion 104. The face plate 105 is formed with a central opening 106 through which the flame fired from the burner nozzle 77 passes to reach the burner chamber 15. The central opening 106 is defined by a solid ring of metal 107 to define a barrier for the passage of combustion air through the face plate 105. The outer peripheral portion 108 of the face plate 105 is preferably angled slightly forwardly toward the terminus of the end portion 104 from the solid ring barrier 107 to urge the flow of combustion air from the ring barrier 107 outwardly toward the end portion 104 of the body member 101.

The outer peripheral portion 108 of the face plate 105 is formed with a plurality of vented openings 110 for the passage of combustion air through the face plate 105. Each vented opening 110 is provided with a deflector member 111 formed from the creation of the opening 110 and bent outwardly from one side thereof. The deflector members 111 are similarly oriented such that the combustion air exiting the vented opening 110 is deflected outwardly toward the body member 101 into the flared end portion 104 in a spiraled manner. Each deflector member 111 is formed to be narrower adjacent the solid ring barrier 107 than at the radially outermost part adjacent the body member 102 to urge the combustion air outwardly in a spiraled manner toward the flared end portion 104.

The operative result of the retention head 100 is that the combustion air is generally forced outwardly through the vented openings 110 into the flared end portion 104 of the body member 101 such that the combustion air forms a spiraled ring of air surrounding the flame fired from the burner nozzle 77 into the burner chamber 15. This spiraled ring of air is maintained in a relatively tight formation by the shape of the retention head 100 and helps keep the flame in a tight pattern into the target 17 mounted in the back wall of the burner chamber 15. This tight flame assures better efficiency of the furnace 10, providing for less ash and smoke, and a better burning of the oil.

The retention head 100 is installed on the burner housing 23 such that the tip of the burner nozzle 77 is positioned ⅛ of an inch forward, i.e. toward the terminus of the end portion 104 of the body member 101, of the face plate 105. The face plate must never be positioned in front of the tip of the burner nozzle 77 as the flow of combustion air around the burner nozzle 77 through the central opening 106 will blow out the flame. The central opening 106 is oriented to allow a portion of the combustion air to flow through the central opening 106 to support the maintenance of the flame fired from the burner nozzle 77. Most of the combustion air, however, is desired to be forced into the spiraled pattern through the vented openings 110 to contain the flame pattern and to support the maintenance of the flame as it progresses toward the target 17.

It will be understood that changes in the details, materials, steps, and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description may be employed in other embodiments without departing from the scope of the invention. Accordingly, the following claims are intended to protect the invention broadly as well as in the specific form shown.

Having thus described the invention, what is claimed is:

1. A retention head for a burner housing of a multi-oil furnace to control the flow of combustion air into a burner chamber to support a flame, said multi-oil furnace including a burner nozzle having a nozzle tip from which said flame is created during operation of said burner nozzle, comprising:

a generally cylindrical body member having a shape corresponding to said burner housing to permit mounting thereof on said burner housing and including, a base portion engageable with said burner housing to define a major axis of said retention head; and an inwardly tapered end portion terminating in an axially concentric opening through which said flame can extend during operation of said multi-oil furnace; and a face plate oriented generally orthogonally to said major axis and including, a solid ring portion defining an axially concentric opening, said nozzle tip projecting through said opening in said face plate such that said nozzle tip is positioned forwardly of the solid ring of said face plate; and an outer peripheral portion having a plurality of vented openings therethrough, each said vented opening having a deflector member oriented angularly relative to said major axis to deflect combustion air into a spiral pattern generally concentric with said major axis.

2. The retention head of claim 1 wherein said vented openings are equidistantly spaced circumferentially around said peripheral portion, said deflector members being positioned radially relative to said major axis around said peripheral portion.

3. The retention head of claim 2 wherein said peripheral portion is inclined forwardly from said solid ring.

4. The retention head of claim 3 wherein each said deflector member is formed such that the width of the deflector member projecting outwardly from said peripheral portion increases radially from said major axis.

5. The retention head of claim 4 wherein said base portion and said end portion of said body member are unitary, said end portion being flared inwardly toward said major axis to receive combustion air from the peripheral portion of said face plate and direct the spirally patterned flow of combustion air into a tight circumferential pattern generally circumferential around said flame.

6. The retention head of claim 5 wherein said face plate is formed as a separate member from said body portion and then affixed to the interior cylindrical surface of said body portion.

7. In a multi-oil furnace having a burner housing including a fan to create a flow of combustion air through said burner housing, said burner housing having a generally cylindrical portion defining a major axis through which said combustion air passes into a burner chamber; a burner nozzle including a nozzle tip located within said burner housing for operable creating a flame into said burner chamber, said burner nozzle being oriented on said major axis within said burner chamber; and a retention head mounted on the cylindrical portion of said burner housing to control the flow of combustion air into the burner chamber to support the flame extending in operation from said nozzle tip, an improved retention head, comprising:

a generally cylindrical body member having a shape corresponding to said burner housing to permit mounting thereof on said burner housing and including, a base portion engageable with said burner housing to define a major axis of said retention head; and an inwardly tapered end portion terminating in an axially concentric opening through which said flame can extend during operation of said multi-oil furnace; and a face plate oriented generally orthogonally to said major axis and including, a solid ring portion defining an axially concentric opening, said nozzle tip projecting through said opening in said face plate such that said nozzle tip is positioned forwardly of the solid ring of said face plate; and an outer peripheral portion having a plurality of vented openings therethrough, each said vented opening having a deflector member oriented angularly relative to said major axis to deflect combustion air into a spiral pattern generally concentric with said major axis.

8. The multi-oil furnace of claim 7 wherein said peripheral portion is inclined forwardly from said solid ring.

9. The multi-oil furnace of claim 8 wherein each said deflector member is formed such that the width of the deflector member projecting outwardly from said peripheral portion increases radially from said major axis.

10. The multi-oil furnace of claim 9 wherein said vented openings are equidistantly spaced circumferentially around said peripheral portion, said deflector members being positioned radially relative to said major axis around said peripheral portion.

11. The multi-oil furnace of claim 10 wherein said base portion and said end portion of said body member are unitary, said end portion being flared inwardly toward said major axis to receive combustion air from the peripheral portion of said face plate, said face plate being formed as a separate member from said body portion and being affixed to the interior cylindrical surface of said body portion.

12. The multi-oil furnace of claim 11 wherein said retention head creates a spirally patterned flow of combustion air into a cylindrical configuration oriented generally circumferential around said flame.

* * * * *